US005281077A

United States Patent [19]

Phillips

[11] Patent Number: 5,281,077

[45] Date of Patent: Jan. 25, 1994

[54] PORTABLE WATERCRAFT LIFT

[76] Inventor: Gary C. Phillips, 1905 W. Lake Dr., Novi, Mich. 48337

[21] Appl. No.: 36,038

[22] Filed: Mar. 23, 1993

[51] Int. Cl.[5] ..... B63C 3/00

[52] U.S. Cl. ..... 414/678; 187/8.59; 405/3

[58] Field of Search ..... 414/678; 405/3; 187/8.59

[56] References Cited

U.S. PATENT DOCUMENTS

| | | | |
|---|---|---|---|
| 2,529,948 | 11/1950 | Jones | 405/3 X |
| 2,632,900 | 3/1953 | Voight | 414/678 X |
| 5,051,027 | 9/1991 | Horton | 405/3 |
| 5,090,841 | 2/1992 | Penick, Jr. | 405/3 |

*Primary Examiner*—Richard A. Schacher
*Attorney, Agent, or Firm*—Robert G. Mentag

[57] ABSTRACT

A portable watercraft lift including a pair of transverse, laterally spaced apart, arch shaped support members which are each detachably connected at the top thereof to one end of an elongated connector beam member. An electrically powered winch, having a winch drum, is detachably mounted on the elongated connector beam member at a point equidistant between the arch shaped support members. Each of the transverse arch shaped support members is provided with lifting cord means and associated pulley means, and one end of each of said cord means is operatively attached to the winch drum. Each of the lifting cord means and associated pulley means are connectable as a combination to a watercraft support member for supporting a watercraft by either a lifting ring, a cradle or lifting straps. When the power winch is operated the cords attached to the drum of the power winches are pulled in from both directions simultaneously creating a lift on a watercraft. The watercraft is lowered by reversing the operation of the power winch.

9 Claims, 3 Drawing Sheets

120
104
124
102
118
14a
116
132
120
68a
122
16a
80a
100
128
134
124
118
132
10a
82a
82a
140
22a
134
120
124
20a
18a
12a
104
116
22a
132
132
134
114
110
128
115
112
20a
22a
16a
24a
108
102
28a
112
114
116
122
90a
26a
115
84a
132
124
106
110
116
123
24a
125
18a
23a
30a
28a
18a
114
134
22a
115
111
30a
20a
114
20a
23a
26a
67a
24a
123
112
119
112
108
125
106
23a
123
28a
115
30a
24a
23a
26a 126
120
121
104
124
102
14a
16a
118
132
130
120
121
100
124
134
128
122
126
18a
116
138
118
132
134
140
136
22a

PORTABLE WATERCRAFT LIFT

BACKGROUND OF THE INVENTION

1. Field of the Invention

The field of art to which this invention pertains may be generally located in the class of devices relating to watercraft lifts. Class 405, Hydraulic and Earth Engineering, United States Patent Office Classification, appears to be the applicable general area of art to which the subject matter similar to this invention has been classified in the past.

2. Description of the Prior Art

This invention relates generally to a portable watercraft lift for raising and lowering personal watercraft, such as paddle boats, fishing boats, ski boats, small runabouts, and the like. Heretofore, various types of transportable watercraft lifts have been proposed for moving a watercraft vertically relative to the water in a lake, or the like, so as to lift the watercraft out of or lower it into the water. An example of such a prior art transportable watercraft is disclosed in U.S. Pat. No. 4,027,492. The prior art type of watercraft lift disclosed in said patent is disadvantageous in that the structure thereof is costly, heavy, cumbersome and complicated, and it cannot be disassembled quickly for fast and easy transporting of the same, for movement to a new use location for operation of the watercraft lift or storage location.

SUMMARY OF THE INVENTION

The present invention provides a portable watercraft lift which is simple and compact in constructions, light in weight, and the parts thereof may be quickly and easily assembled and set up for use. The portable watercraft lift may also be quickly and easily disassembled and transported when not in use to a small storage facility.

The portable watercraft lift includes a pair of vertical, transversely disposed, laterally spaced apart, arch shaped support members which are each detachably connected at the top thereof to one end of an elongated connector beam member. An electrically powered winch is detachably mounted on the elongated connector beam member at the center or equidistant point between the arch shaped support members. Operatively attached to the drum of the electrically powered winch are two horizontally disposed cords that spool on the winch drum and which each extends from one of the arch shaped support members. The cords may each comprise a rope, or be made as a cable from wire strands. Each of said horizontally disposed cords is operatively connected to vertically disposed cord means which travel over pulley means carried by each of the arch shaped support members. The vertically disposed cord means carried by the arch shaped support members are adapted to be attached to a pair of watercraft support members, whereby when the electrically powered winch drum is rotated in one direction, the two horizontally disposed cords are wound on the winch drum in one direction to raise a watercraft from the surface of a body of water, and when the winch drum is rotated in the opposite direction the watercraft will be lowered to the surface of the body of water. The watercraft support members may comprise straps or cradles that engage the bottom of a watercraft, or lifting rings that are mounted on the upper deck of a watercraft.

The elongated connector beam member can be quickly and easily detached from the pair of vertical, arch shaped support members for transporting the watercraft lift for set up in a new location, or for transport to a storage facility. The vertically disposed cord means and the associated pulley means may also be quickly and easily detached from the arch shaped support members for purposes of transporting the watercraft lift to a new use or storage location. The watercraft lift is easy to use and it does not require a large space for storage of the lift or for transporting the lift from one location to another. If desired, a suitable cover canopy may be detachably mounted on the watercraft lift, and be supported by the elongated connector beam member and the vertical, arch shaped support members. The vertical, arch shaped support members are provided with foot base members for supporting the lift on the ground below the water level.

DESCRIPTION OF THE PREFERRED EMBODIMENTS

Figure 1A:
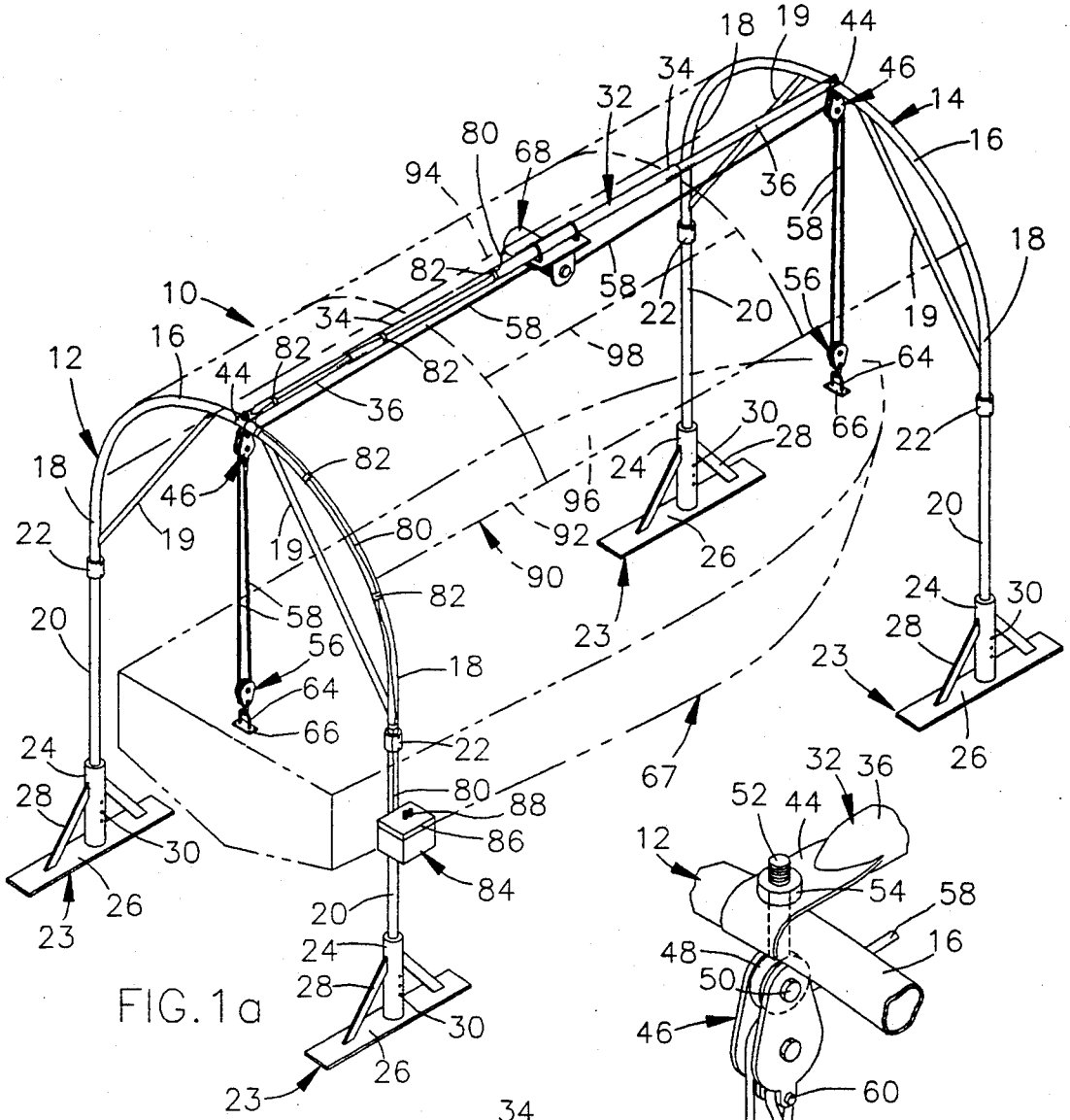
FIG. 1*a* is an elevation perspective view of a watercraft lift made in accordance with the principles of the present invention and illustrating a first embodiment of the invention.

Referring now to the drawings, and in particular to FIG. 1*a*, the numeral 10 generally designates a first embodiment watercraft lift made in accordance with the invention and which comprises a pair of vertical, transversely disposed, laterally spaced apart arch shaped support members, generally indicated by the numerals 12 and 14. The arch shaped support members 12 and 14 are identical in construction and the same reference numerals have been used to indicate the identical parts for each of the arch shaped support members.

As shown in FIG. 1*a* each of the arch shaped support members 12 and 14 includes a transverse beam portion 16 which is an inverted U-shaped or arch shaped in cross section. The arch shaped support members 12 and 14 are each illustrated as being a suitable tubular member, such as a metal pipe, or plastic pipe. The lower ends of the transverse beam portion 16 terminate with vertical legs 18 which are each detachably connected to the upper end of vertical tubular pipe leg 20 by a suitable coupling, such as a pipe coupling 22. The transverse inverted U-shaped or arch shaped beam 16 is provided with a pair of tubular braces 19 which are disposed so as to angle upwardly and inwardly and have their ends fixedly secured, by any suitable means, to the transverse beam leg 16.

The lower ends of each of the vertical support legs 20 are slidably mounted in a foot base, generally indicated by the numeral 23. Each of the foot bases 23 includes a vertically disposed tubular member 24, which has an inner diameter made to a size to slidably receive the lower end of a support pipe leg 20 and to hold the same in a vertically adjusted position by a suitable retainer pin 30. The lower end of each of the foot base tubular members 24 is fixedly secured, by any suitable means, as by welding, to a flat rectangular plate 26. The foot bases 23 each have a pair of diagonally disposed braces 28, which have their lower ends fixedly connected to the flat rectangular plate 26 and their upper ends fixedly connected to opposite sides of the tubular member 24.

Figure 4:
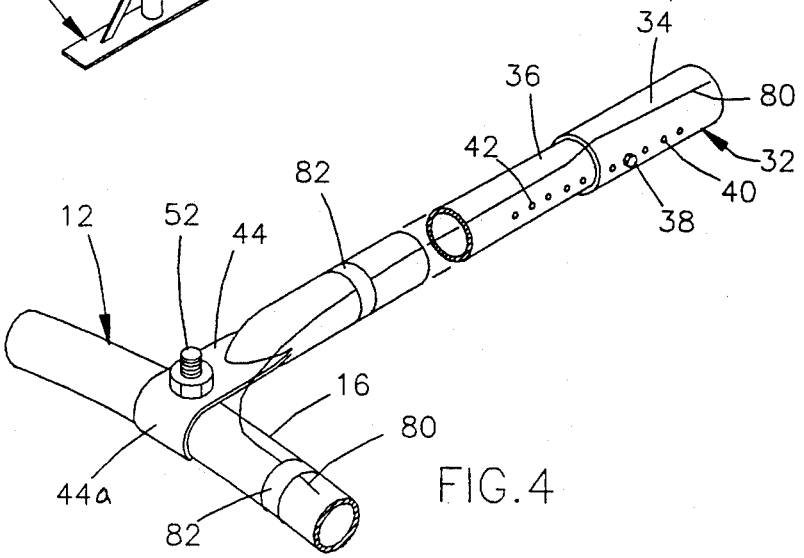
FIG. 4 is a fragmentary, elevation perspective view of a portion of an arch shaped support member attached to the elongated connector beam member employed in the embodiment of FIGS. 1*a*–1*c*.

As shown in FIG. 1*a*, the two transverse, arch shaped support members 12 and 14 are detachably connected together by an elongated connector beam, generally indicated by the numeral 32, which may comprise a metal pipe or a plastic pipe. The elongated connector beam member 32 includes a pair of short end portions 36 which are telescopically connected to an elongated middle portion 34. As illustrated in FIG. 4, the middle portion 34 of the elongated connector beam member 32 is made to a larger diameter than the short end portions 36, so that the short end portions 36 are slidably mounted in the opposite ends of the middle portion 34. Each of the short end portions 36 of the elongated connector beam member 32 is provided with a plurality of longitudinally spaced apart holes 42 which are adapted to be aligned with corresponding longitudinally spaced apart holes 40 in the elongated connector beam middle portion 34 for the reception of a suitable retainer pin 38. The last described structure permits the longitudinal space between the arch shaped support members 12 and 14 to be adjusted to accommodate various lengths of watercraft.

The outer ends 44 of the short end portions 36 of the elongated connector beam member 32 are detachably connected to the mid-point of the transverse arch shaped beam members 16 by the structure shown in FIG. 4. The outer ends 44 of each of the elongated connector beam member short end portions are flattened. As shown in FIG. 4, the outer flat ends 44 of the elongated connector beam short end portions 36 terminate in a downward curved shape, indicated by the numeral 44*a*, so as to seat around the outer cylindrical periphery of the arch shaped beam end members 16. The flattened ends 44 of the elongated connector beam member short end portions 16 are detachably secured to the transverse arch shaped members 16 by a suitable bolt 52, as shown in FIG. 4 and a lock nut 54 (FIG. 1*b*).

Figure 1C:
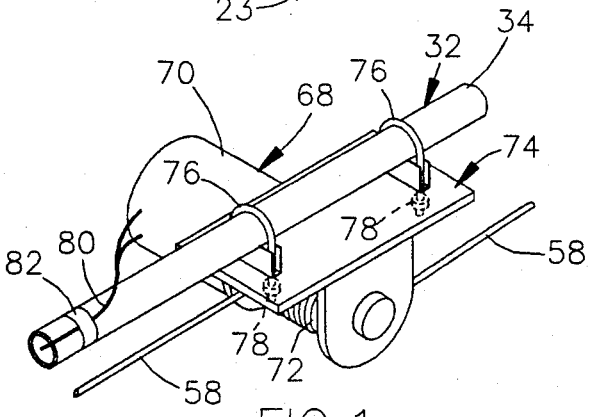
FIG. 1*c* is an elevation, perspective view of the electrically powered winch employed in the first embodiment watercraft lift illustrated in FIG. 1*a*.
Figure 1B:
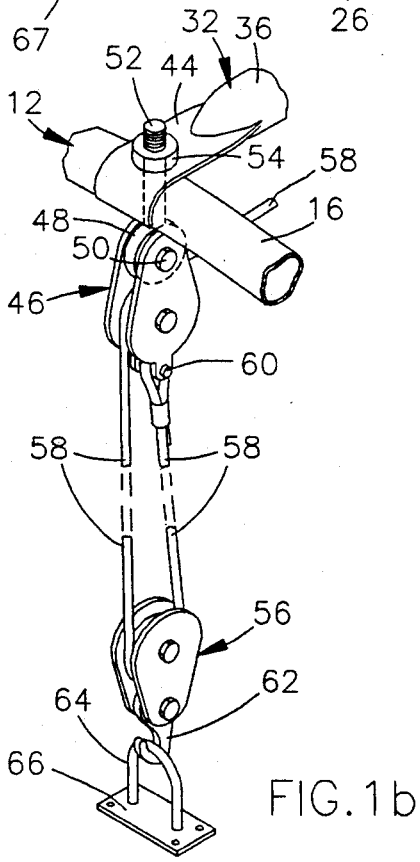
FIG. 1*b* is a fragmentary, elevation perspective view of a vertically disposed cord means employed on each of the arch shaped support members of the watercraft lift illustrated in FIG. 1*a*.

As shown in FIG. 1*a*, and in detail in FIG. 1*b*, the bolts 52 which secure the flattened ends 44 of the elongated connector beam member 32 to a central position on the transverse arch shaped beam members 16 also detachably secure an upper vertical lift pulley, generally indicated by the numeral 46, to the underside of the transverse arch shaped beam members 16. As shown in FIG. 1*b*, the lower end of each of the bolts 52 is provided with a ring or eye member 48 to which is pivotally secured, an upper vertical lift pulley 46, by a suitable transverse retainer pin 50.

As shown in FIG. 1*a*, each of the upper vertical lift pulleys 46 has one end of a vertically disposed cord 58 secured to it by a suitable retainer pin 60. The cords 58, as well as all of the other hereinafter mentioned cords, comprise a rope, or it may also comprise a cable made from wire strands. As shown in FIG. 1*a*, the vertically disposed cables 58 extend downwardly and pass around a lower vertical lift pulley, generally indicated by the numeral 56, and thence upwardly and over the upper vertical lift pulleys 46. As illustrated in FIG. 1*b*, each of the lower vertical lift pulleys 56 has pivotally mounted on the lower end thereof a hook 62 for operative engagement with a lift ring 64 which is fixedly secured on a flat attachment plate 66. The lift rings 64 and the associated attachment plates 66 comprise watercraft support members which are normally mounted on small watercraft for lifting purposes. As shown in FIG. 1*a*, one of the lifting rings 64 and its associated attachment plate 66 are fixedly mounted on the forward end of a watercraft, generally indicated by the numeral 67, and a second lifting ring and attachment plate 66 is mounted on the water craft 67 adjacent the aft end thereof.

As shown in FIG. 1*a*, each of the vertical lift cords 58 passes over its respective upper lift pulley 46, and it then extends horizontally inward, and functions as a horizontally disposed cord which is marked with the same reference numeral 58. The inner ends of the horizontally disposed cords 58 are operatively wound on the winch drum 72 (FIG. 1*c*) of an electrically operated reversible power winch, generally indicated by the numeral 68. A suitable electrically operated power winch for carrying out the function of the power winch 68 is a winch available on the market from Superwinch, Inc., Winch Road, Putnam, Conn. 06260, under the name "Superwinch", Model No. X2. As shown in FIG. 1*c*, the power winch 68 includes an electric motor 70 which is operatively connected to the winch drum 72. The power winch 68 includes a mounting plate 74 which is detachably secured to the elongated connector beam member central portion 34, by any suitable means, as by a pair of U-shaped clamps 76 and suitable lock nuts 78. The U-shaped clamps 76 each have a pair of legs which extend down through suitable holes formed through the mounting plate 74, and wherein the lock nuts 78 are secured on the threaded lower ends of the legs of the clamps 76.

As shown in FIG. 1*a*, the electric power for operating the power winch 68 is supplied by a suitable 12 volt battery, generally indicated by the numeral 84, which may be optionally clamped to one of the transverse arch shaped support member legs 20 by any suitable means, or it may be positioned on the ground on a dock adjacent the portable watercraft lift 10. The battery 84 is operatively connected to the power winch motor 70 by suitable electric lead wires, indicated by the numeral 80, which may be secured to the transverse arch shaped support member portions 16, 18 and 20, and the elongated connector beam member 32, by suitable plastic clips or velcro tape members, indicated by the numeral 82. The battery 84 may be provided with a suitable solar charger unit, indicated by the numeral 86, as well as control buttons 88 for operating the power winch 68 in the forward and reverse directions.

As illustrated in FIG. 1*a*, the portable watercraft 10 may be optionally provided with a suitable cover, generally indicated by the numeral 90. The cover 90 would be releasably attached to the transverse arch shaped support members 12 and 14 by suitable straps or other means. The numerals 92 and 94 indicate the side edges of an optional cover 90. The optional cover 90 may be provided with a flap, indicated by the numeral 96, which could be opened upwardly along a hinge line, indicated by the numeral 98.

The portable watercraft lift 10 is especially adapted for use in a shallow lake. It is constructed and arranged so that it can be quickly and easily assembled and placed in an operative position in a shallow lake by one or two persons. It can also be quickly disassembled by one or two persons and transported to a new use location, or to a storage facility. The portable watercraft lift 10 can be made to any width, length or height, in accordance with the size of the watercraft to be lifted. In use, assuming that the portable watercraft lift 10 has been mounted in an operative position in a lake over a watercraft 67, the power winch 68 would be operated by the controls 88 to lower the pulleys 56 and the hooks 62 to positions over the watercraft support members 64 and 66. The hooks 62 on the pulleys 56 would then be moved under the U-shaped rings 64, and the power winch 68 operated to move the pulleys 56 upwardly, so as to engage the hooks 62 with the U-shaped rings 64. The operation of the power winch 68 is then continued in a direction to wind simultaneously the horizontally disposed cords 58 onto the winch drum 72 from both directions. The power winch 68 would be operated until the watercraft 67 has been raised to a desired level above the water in the lake. In order to lower the watercraft 67 into the water, the power winch 68 would be operated in a reverse direction to unwind simultaneously the horizontally disposed cords 58 from the winch drum 72 and lower the watercraft 67 into the water with the coaction of the downward pull exerted by the weight of the watercraft 67.

Figures 2A, 2B:
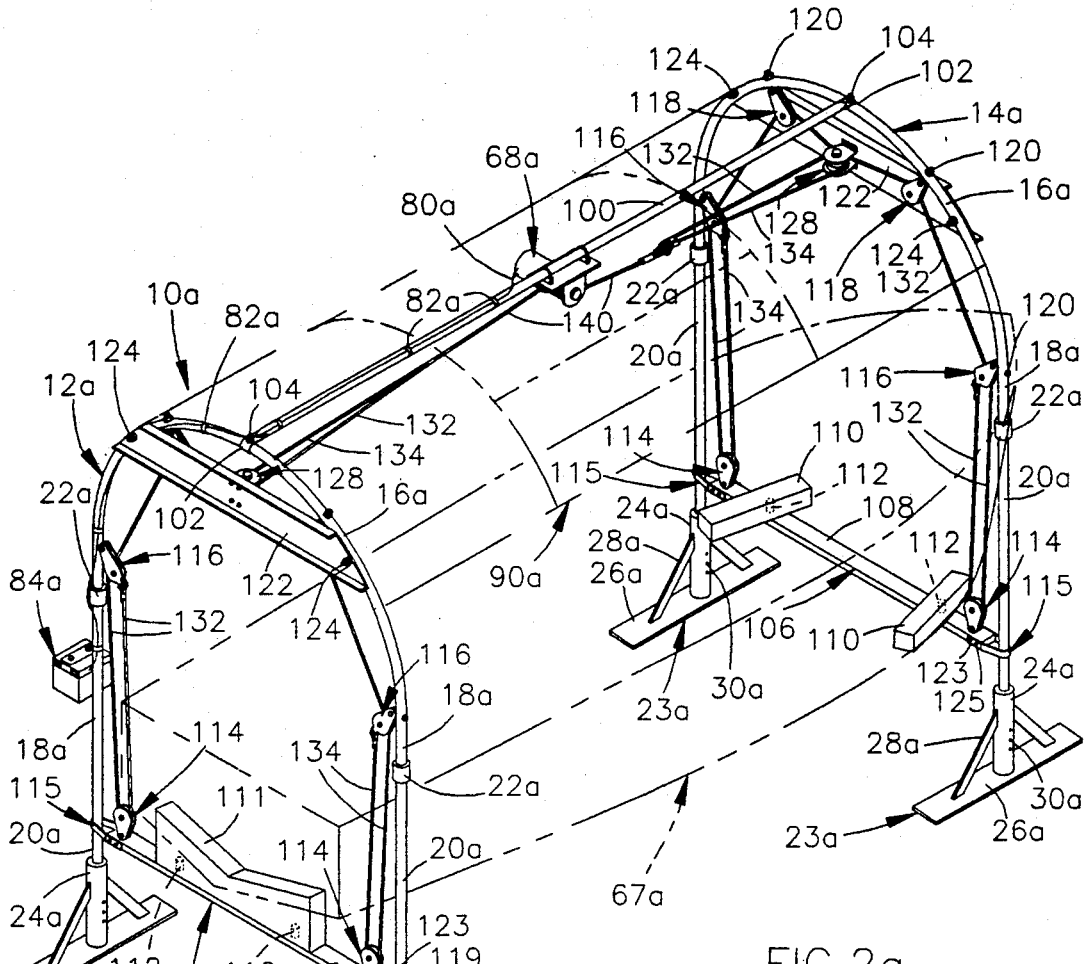
FIG. 2*a* is an elevation, perspective view of a second embodiment watercraft lift made in accordance with the invention.
FIG. 2*b* is a fragmentary, elevation perspective view of a part of the pulley means employed on each of the arch shaped support members of the second embodiment illustrated in FIG. 2*a*.

FIGS. 2*a* and 2*b* disclose a second embodiment of the invention in which the numeral 10*a* generally designates a watercraft lift in which the parts thereof that are the same as the parts in the first embodiment have been marked with the same reference numerals followed by the small letter "a". As shown in the FIG. 2*a*, the transverse arch shaped support members 12*a* and 14*a* are interconnected with a unitary elongated connector beam member 100, instead of the extendable elongated connector beam member 32 of the first embodiment illustrated in FIG. 1*a*. The ends of the elongated connector beam member 100 are flattened in the same manner as the ends of the corresponding elongated connector beam member 32 were formed for the first embodiment of FIG. 1*a*. The flattened ends of the elongated connector beam 100 are designated by the numeral 102 and they have a curved portion which seats around the periphery of the transverse arch shaped beam members 16*a* and 16*b*, and are detachably connected thereto by suitable bolt and nut means, generally indicated by the numeral 104.

In the second embodiment of FIG. 2*a*, the watercraft support members comprise cradle members, generally indicated by the numeral 106, which are operatively mounted within the transverse arch shaped support members 12*a* and 14*a*. Each of the watercraft cradle support members 106 comprise an elongated transverse beam or plank 108 which may be made from any suitable wood or lightweight metal. The watercraft cradle support members 106 positioned within the transverse arch shaped support member 14*a* is provided with a pair of laterally spaced apart cradle blocks 110, which are secured to its respective transverse beam 108 by suitable machine screws 112. The cradle blocks 110 would be angularly disposed for supporting engagement with the forward bottom surface of a watercraft 67*a* to be raised and lowered by the watercraft lift 10*a*. The watercraft cradle support members 106 positioned within the transverse arch shaped support member 12*a* is provided with a transverse block 111 that has a V-shaped upper surface for supporting engagement with the aft bottom surface of a watercraft 67*a*. The cradle block 111 is secured to the cradle transverse beam 108, by any suitable means, as by machine screws 112.

As shown in FIG. 2*a*, each of the watercraft cradle transverse beams 108 are provided with a pair of guide brackets, generally indicated by the numeral 115, to prevent swaying of the cradle support members 108 during loading and unloading of a watercraft 67*a* thereonto or therefrom. Each of the guide brackets 115 comprises a U-shaped outer end portion 119 which is adapted to be seated around and be slidably mounted on the adjacent vertical leg 20*a* of the respective arch shaped support member 12*a* or 14*a* that it is associated with. Each of the guide brackets 115 includes a pair of integral rigid straps or arms 123 which extend inwardly from the U-shaped outer end portion 119. The bracket arms 123 are positioned on opposite sides of the ends of each transverse cradle beam 108, and they are fixedly secured thereto by suitable attachment screws 125.

As shown in FIG. 2*a*, each end of each of the transverse watercraft cradle support beams 108 are operatively attached to a lower single block pulley, generally indicated by the numeral 114, by a suitable eye bolt and nut means, in the same manner as the single block pulley 46 is secured to the transverse arch shaped beam member 46, as by the eye bolt 52 and the nut 54, as shown in FIG. 1*b*. An upper single block pulley, generally indicated by the numeral 116, is operatively mounted above each of the lower single block pulleys 114, in each of the transverse arch shaped support members 12*a* and 14*b*. The upper single block pulleys 116 are secured by a suitable eye bolt 120 to the lower leg ends 18*a* of the two transverse arch shaped support members 12*a* and 14*a*. The eye bolts 120 are structurally the same as the aforementioned eye bolts 52 and lock nuts 54. As viewed in FIG. 2*a*, from the inner side of the transverse arch shaped support member 14*a*, a cord 132, disposed adjacent right side transverse arch shaped support leg 20*a*, has one end secured to the upper pulley 116 and it then passes downwardly and around the single pulley 114 and back up vertically through the last mentioned pulley 116, and thence the cord 132 angles upwardly and inwardly under the transverse beam member 16*a* to where it passes over a single pulley, generally indicated by the numeral 118. The pulley 118 is fixedly secured to the right underside of the transverse arch shaped beam 16*a* by an eye bolt 120. The cord 132 then passes horizontally inward and passes around one wheel of a double wheel pulley 128, and it then extends horizontally inward under the elongated connector beam 100 to the power winch 68*a*. The double wheel pulley 128 is fixedly secured to a transverse mounting plate 122. The transverse mounting plate 122 is fixedly secured to the transverse arch shaped beam member 16*a* (FIG. 2*b*) by a pair of suitable bolts 124 and lock nuts 126. As shown in FIG. 2*b*, the pulley 118 is secured to the transverse arch shaped beam member 16*a* by a suitable eye bolt 120 and lock nut 121, which are structurally the same as the aforementioned eye bolts 52 and lock nuts 54. As shown in FIG. 2*b*, the double wheel pulley 128 is fixedly secured t the mounting plate 122 by a plurality of suitable bolt and nut means 130.

As shown in FIG. 2*a*, a vertical lift cord 134, disposed adjacent the left side transverse arch shaped support leg 20*a* has one end fixedly secured to the upper pulley 116 which is disposed above the lower lift pulley 114, as viewed from the inside of the transverse arch shaped support member 14*a*. The cord 134 extends downwardly around the left side lower pulley 114, and thence upwardly and over the left side upper pulley 116, and thence over a pulley 118 which is secured to the left side of the transverse arch shaped beam 16*a*, and thence over the other of the two wheels on the double wheel pulley 128. The last mentioned pulley 118 is fixedly secured to the transverse arch shaped beam member 16*a* by an eye bolt 120 and lock nut 121 (FIG. 2*b*). The last mentioned upper pulley 118 guides the cord 134 inwardly and upwardly, and then horizontally around the double wheel pulley 128, from which it extends inwardly under the elongated connector beam member 100 toward the power winch 68*a*. As shown in FIG. 2*a*, the horizontal ends of the cords 132 and 134 are connected together, as shown in FIG. 2*b*. The horizontal ends of the cords 132 and 134 are provided with cable eyes 136 through which is operatively mounted a cable eye 138 on one end of a horizontal winch cable 140. The other end of the winch cable 140 is wound on the drum of the power winch 68*a*.

The transverse arch shaped support member 12*a* is provided with identical lifting cords 132 and 134, and pulley means 116, 118 and 128, as illustrated in FIG. 2*a*. The last mentioned cords 132 and 134 are also connected to a single winch cable 140 which is mounted around the drum on the power winch 68*a*.

In use, the watercraft lift 10*a*, illustrated in FIGS. 2*a* and 2*b*, would be operated in the same manner as described hereinbefore for the operation of the embodiment of FIG. 1*a*. The vertical lift cords 132 and 134 function with the single pulleys 114, 116, 118, and the double wheel pulleys 128 to provide a simultaneous equal lifting action on the forward and aft ends of the watercraft 67*a* when the single horizontal winch cables 140 are reeled onto the drum of the power winch 68*a*. The watercraft 67*a* would be lowered from a raised position by merely reversing the operation of the power winch 68*a*, as described hereinbefore for the first embodiment of FIG. 1*a*.

Figure 3:
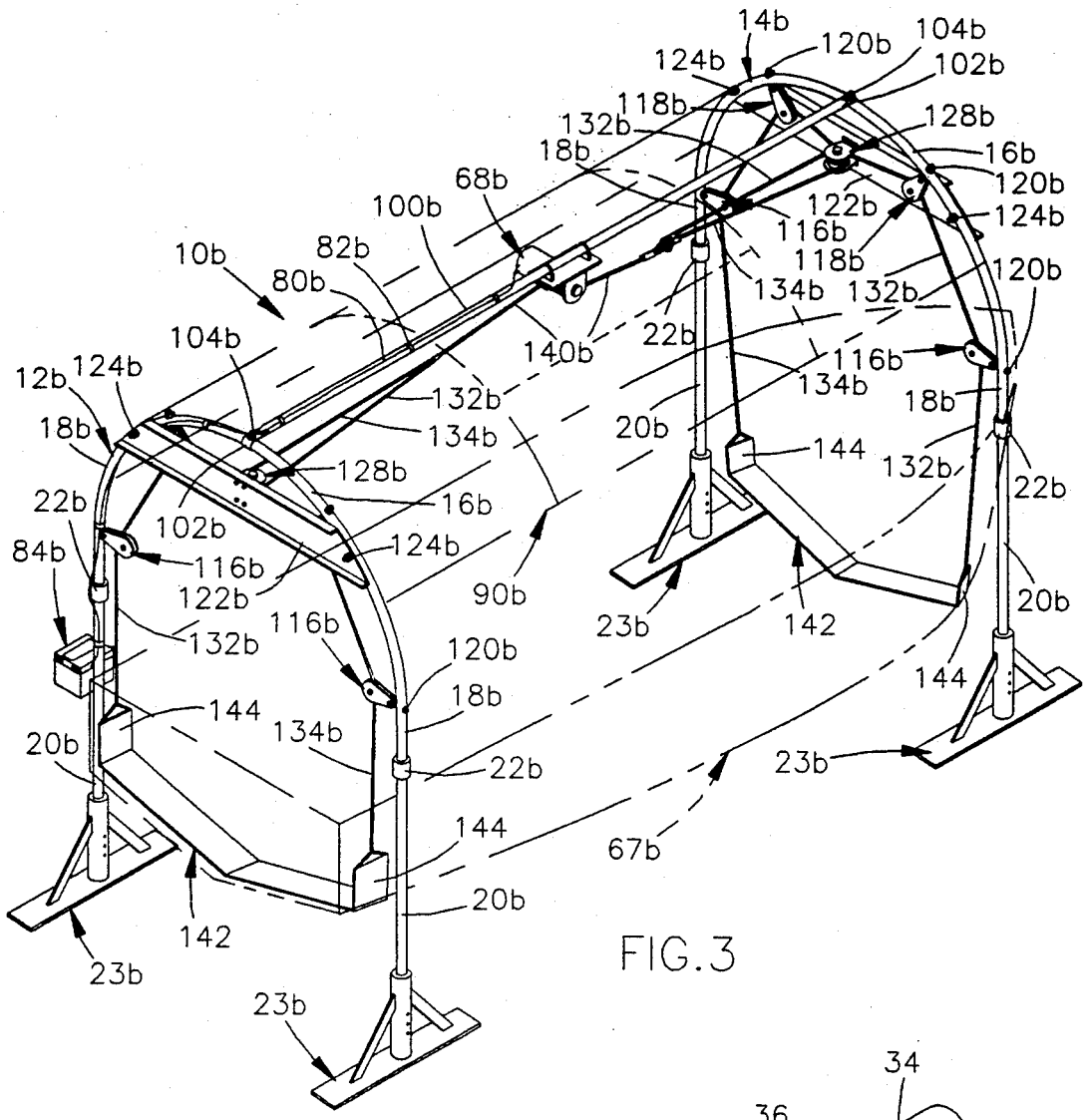
FIG. 3 is an elevation, perspective view of a third embodiment watercraft lift made in accordance with the invention.

In the third embodiment illustrated in FIG. 3, the support members 106 of the second embodiment have been replaced with transverse watercraft support straps, generally indicated by the numeral 142. Each end of the straps 142 has an integral, upwardly extended end portion 144 which is operatively attached to the lower end of the respective lift cables 132*b* and 134*b* which depend from the single pulleys 116*b*. The third embodiment does not require any lower single pulleys 114. The lifting and lowering operations of the watercraft lift 10*b* illustrated in FIG. 3 would be carried out in the same manner as described hereinbefore for the embodiment of FIG. 2*a*.

What is claimed is:

1. A portable watercraft lift (10) comprising:

(a) a pair of vertical, transverse support members (12,14) which are laterally spaced apart;

(b) each of said transverse support members (12,14) having a transverse beam member (16) and a vertical depending leg means (18,20) on each end thereof;

(c) each of said transverse beam member depending leg means (18,20) being provided with foot base means (23) for supporting said pair of transverse support members (12,14) by engagement with the ground below the water level of a body of water;

(d) each of said transverse support beam members (16) being detachably connected, at a transverse mid-point thereof, to one end of an elongated connector beam member (32,100);

(e) a power operated winch (68), having a winch drum, releasably mounted on said elongated connector beam member (32,100) at a point equidistant from each transverse support member (12,14);

(f) a power source (84) with operator control means (88) operatively connected to said power operated winch (68) for controlling the operation thereof;

(g) each of said transverse support members (12,14) being provided with lifting cord means (58,132,134, 140) and associated pulley means (46,56,114,116,118,128), and having one end (58,140) of each of said cord means operatively attached to said winch drum; and, (h) each of said lifting cord means (58,132,134, 140) and associated pulley means (46,56,114,116,118,128) being connectable to a watercraft support member (64,106,142) for supporting a watercraft (67) when the power operated winch (68) is operated to wind said one (58,140) end of each of the cord means onto the winch drum, to lift the watercraft (67) when the power winch (68) is operated by said operator control means (88) to rotate said power winch drum, in one direction, and to lower the watercraft (67) when the power winch is operated by said operator control means (88) to rotate said power winch drum in the in the other direction.

2. A portable watercraft lift (10) as defined in claim 1, wherein:

(a) said elongated connector beam member (32) includes adjustment means for adjusting the length of said elongated connector beam member (32) to adjust the lateral spaced apart positions of the transverse support members (12,14).

3. A portable watercraft lift (10) as defined in claim 1, wherein:

(a) said watercraft support member comprises a watercraft lifting ring (64) attached to a watercraft (67).

4. A portable watercraft lift (10) as defined in claim 1, wherein:

(a) said watercraft support member comprises a watercraft cradle (106) disposed under a respective support beam member (16*a*).

5. A portable watercraft lift (10) as defined in claim 4, wherein:

(a) each of said watercraft cradles (106) is provided with a guide bracket (115) on each end which slidably engages an adjacent leg means (20*a*) when the watercraft cradles (106) are moved upwardly and downwardly during watercraft lifting and lowering operations.

6. A portable watercraft lift (10) as defined in claim 1, wherein:

(a) said watercraft support member comprises a lifting strap disposed under a respective support beam member (16*b*).

7. A portable watercraft lift (10) as defined in claim 1, wherein:

(a) each of said transverse support member vertical depending leg means (18,20) comprise a plurality of leg parts detachably connected together.

8. A portable watercraft lift (10) as defined in claim 1, wherein:

(a) the transverse beam member (16) for each transverse support member (12,14) is arch shaped.

9. A portable watercraft lift (10) as defined in claim 1, wherein:

(a) foot base means (23) on each of said transverse support member depending leg means (18,20) are detachably mounted thereon.

* * * * *